US008216443B2

(12) United States Patent
Håkansson et al.

(10) Patent No.: US 8,216,443 B2
(45) Date of Patent: Jul. 10, 2012

(54) PROCESS FOR PRODUCING ALKALI METAL CHLORATE

(75) Inventors: Bo Håkansson, Sundsvall (SE); Eduardo Fontes, Stockholm (SE); Fredrik Herlitz, Sundsvall (SE); Viktoria Lindstrand, Sundsvall (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 10/608,152

(22) Filed: Jun. 30, 2003

(65) Prior Publication Data

US 2004/0124094 A1 Jul. 1, 2004

Related U.S. Application Data

(60) Provisional application No. 60/393,384, filed on Jul. 5, 2002.

(51) Int. Cl.
*C25B 1/24* (2006.01)
*C25B 1/26* (2006.01)
*C25B 1/46* (2006.01)

(52) U.S. Cl. ..... 205/502; 205/503; 205/504; 205/505; 205/500

(58) Field of Classification Search ..... 205/503, 205/504, 505
See application file for complete search history.

(56) References Cited

U.S. PATENT DOCUMENTS 2,569,329 A * 9/1951 Osborne et al. ..... 205/516
3,124,520 A 3/1964 Juda ..... 204/86
3,329,594 A * 7/1967 Anthony et al. ..... 205/504
3,539,486 A * 11/1970 Fleck ..... 205/338
3,897,320 A * 7/1975 Cook, Jr. ..... 205/345
4,046,653 A * 9/1977 de Nora et al. ..... 205/500
4,243,508 A * 1/1981 Dankese ..... 204/253
4,269,675 A 5/1981 Ezzell ..... 204/98

(Continued)

FOREIGN PATENT DOCUMENTS

EP 1067215 1/2001

(Continued)

OTHER PUBLICATIONS

L. Czarnetzki et al, Formation of hypochlorite, chlorate and oxygen during NaCl electrolysis from alkaline solutions at an RuO2/TiO2 anode, 1992, Journal of Applied Electrochemistry, vol. 22, pp. 315-324.*

(Continued)

*Primary Examiner* — Harry D Wilkins, III
(74) *Attorney, Agent, or Firm* — Robert C. Morriss; David J. Serbin

(57) ABSTRACT

The invention relates to a process for producing alkali metal chlorate in an electrolytic cell that is divided by a cation selective separator into an anode compartment in which an anode is arranged and a cathode compartment in which a gas diffusion electrode is arranged. The process comprises introducing an electrolyte solution containing alkali metal chloride into the anode compartment and an oxygen-containing gas into the cathode compartment.

The invention also relates to an electrolytic cell for the production of alkali metal chlorate comprising a cation selective separator dividing the cell into an anode compartment in which an anode is arranged and a cathode compartment in which a gas diffusion electrode is arranged. An inlet for electrolyte solution and an outlet for electrolysed solution are provided in the anode compartment and an inlet for introducing oxygen-containing gas is provided in the gas chamber. The invention also relates to a plant comprising the electrolytic cell and the use thereof for the production of alkali metal chlorate and/or chlorine dioxide.

19 Claims, 1 Drawing Sheet

U.S. PATENT DOCUMENTS

| | | | | | |
|---|---|---|---|---|---|
| 4,299,682 | A | * | 11/1981 | Oda et al. | 204/265 |
| 4,364,805 | A | | 12/1982 | Rogers | 204/98 |
| 4,528,077 | A | * | 7/1985 | Fair et al. | 205/501 |
| 5,104,499 | A | | 4/1992 | Millet | |
| 5,294,307 | A | * | 3/1994 | Jackson | 205/349 |
| 5,419,818 | A | | 5/1995 | Wanngard | 204/95 |
| 5,766,429 | A | | 6/1998 | Shimamune | 204/257 |
| 5,938,901 | A | | 8/1999 | Shimamune | 204/283 |
| 6,117,286 | A | * | 9/2000 | Shimamune et al. | 204/252 |

FOREIGN PATENT DOCUMENTS

| | | |
|---|---|---|
| FR | 9206112 | 11/1993 |
| SU | 281435 | 12/1970 |

OTHER PUBLICATIONS

English language abstract of CN 1076226, dated Sep. 15, 1993.

Kaki, E.E. et al, "Simultaneous electrosynthesis of alkaline hydrogen peroxide and sodium chlorate", Journal of Applied Electrochemistry, vol. 20, 1990, pp. 932-940.

Article from China Academic Journal Electronic Publishing House, Nov. 1997, pp. 18-29.

Translation of an Office Action dated May 17, 2007 in a corresponding Russian application.

Translation of an Office Action dated Feb. 16, 2007 in a corresponding Chinese application.

* cited by examiner

PROCESS FOR PRODUCING ALKALI METAL CHLORATE

This application claims priority from provisional application No. 60/393,384 filed Jul. 5, 2002.

The present invention relates to a process for producing alkali metal chlorate, as well as an electrolytic cell and a plant for carrying out the process. The invention further relates to the use of the electrolytic cell and the plant for the production of alkali metal chlorate and/or chlorine dioxide.

BACKGROUND OF THE INVENTION

Alkali metal chlorate, and especially sodium chlorate, is an important chemical in the cellulose industry where it is used as a raw material in the production of chlorine dioxide, which is an important bleaching chemical for cellulose fibres. Alkali metal chlorate is conventionally produced by electrolysis of alkali metal chlorides in open non-divided electrolytic cells provided with hydrogen evolving cathodes. The overall chemical reaction taking place in such cells is $MeCl+3H_2O \rightarrow MeClO_3+3H_2$, where Me is an alkali metal. This reaction has a cell voltage of 3 V.

In the past, also electrolytic cells provided with oxygen consuming gas diffusion electrodes have been attempted for the production of chlorate. The English language Chemical Abstract (AN 1994:421025) of Chinese Patent Application No. 1076226 discloses such cells for the preparation of sodium chlorate. The gas diffusion electrode reduces oxygen supplied to the gas chamber adjacent to the gas diffusion electrode. The reduction reaction taking place at the gas diffusion electrode (gas diffusion cathode) is $2H_2O+O_2+4e^- \rightarrow 4OH^-$. The oxidation reaction taking place at the anode is $2Cl^- \rightarrow Cl_2+2e^-$. The cell voltage for the overall chemical reaction in the gas diffusion electrode cell is about 2 V, which implies that considerable operation costs can be saved by replacing the above described hydrogen evolving cathode with a gas diffusion electrode acting as cathode.

Operation of a cell as disclosed in English language abstract of Chinese Patent Application No.1076226, however, will instantly lead to poisoning of the gas diffusion electrode since the reaction products HClO , $ClO^-$, and $ClO_3^-$ formed at the anode will diffuse freely in the electrolyte and undesired side reactions will inevitably take place at the gas diffusion electrode according to the formulas below:

$$HClO+2e^- \rightarrow Cl^-+OH^- \quad (1)$$

$$ClO^-+H_2O+2e^- \rightarrow Cl^-+2OH^- \quad (2)$$

$$ClO_3^-+3H_2O+6e^- \rightarrow Cl^-+6OH^- \quad (3)$$

In many alkali metal chlorate processes, alkali metal chromates are employed to suppress reactions 1-3. However, alkali metal chromates can also have a negative impact on the gas diffusion electrode which quickly will deactivate upon contact with the chromate ions.

Production of chlorate may require considerable amounts of hydrochloric acid and alkali metal hydroxide, which also implies a considerable cost. Furthermore, the handling of these chemicals is complicated because of the rigorous safety requirements involved in transportation, storage and dosage.

An object of the present invention is to overcome the problems referred to above and at the same time provide an energy-efficient electrolytic process for the production of alkali metal chlorate. A further object of the invention is to provide a process which makes a large portion of externally added pH-adjusting chemicals superfluous to the process.

THE INVENTION

The invention relates to a process for producing alkali metal chlorate in an electrolytic cell divided by a cation selective separator into an anode compartment in which an anode is arranged and a cathode compartment in which a gas diffusion electrode is arranged. The process comprises introducing an electrolyte solution containing alkali metal chloride into the anode compartment and an oxygen-containing gas into the cathode compartment; electrolysing the electrolyte solution to produce an electrolysed solution in the anode compartment, electrolysing oxygen introduced into the cathode compartment resulting in the formation of alkali metal hydroxide in the cathode compartment; transferring the electrolysed solution from the anode compartment to a chlorate reactor to react the electrolysed solution further to form a concentrated alkali metal chlorate electrolyte.

In this process, the same space of the cathode compartment functions both as a gas chamber for oxygen-containing gas and a chamber for alkali metal hydroxide production.

According to a preferred embodiment, the gas diffusion electrode is arranged on the cation selective separator to minimise the ohmic resistance.

According to another preferred embodiment, the process is run in a cell in which the gas diffusion electrode divides the cathode compartment into a gas chamber on one side of the gas diffusion electrode and an alkali metal hydroxide chamber on the other side thereof confined between the gas diffusion electrode and the cation selective separator. The process comprises introducing an electrolyte solution containing alkali metal chloride into the anode compartment, introducing an alkali metal hydroxide solution into the alkali metal hydroxide chamber and an oxygen-containing gas into the gas chamber; thereby electrolysing the electrolyte solution to produce an electrolysed solution in the anode compartment, electrolysing oxygen introduced into the gas chamber resulting in the formation of additional alkali metal hydroxide in the alkali metal hydroxide chamber; transferring the electrolysed solution from the anode compartment to the chlorate reactor to react the electrolysed solution further to form a concentrated alkali metal chlorate electrolyte.

Preferably, the electrolytic cells may be pressurised up to about 10 bar, preferably up to about 5 bar. This may be achieved by applying an appropriate overpressure of an oxygen-containing gas in the gas chamber and an inert gas in the anode compartment.

The cation selective separator, which preferably is substantially resistant to chlorine and alkali metal hydroxide, enables efficient production of an electrolysed solution and concentrated alkali metal hydroxide with a low content of chlorate ions and chloride ions in the alkali metal hydroxide chamber. The cation selective separator preferably is a cation selective membrane. Suitably, the cation selective membrane is made from an organic material such as fluorine-containing polymer of e.g. perfluorinated polymers. Other suitable membranes may be made of polyethylene, polypropylene and polyvinyl chloride sulphonated, polystyrene or teflon-based polymers or ceramics. There are further commercially available membranes suitable for use such as Nafion™ 324, Nafion™ 550 and Nafion™ 961 available from Du Pont, and Flemion™ available from Asahi Glass.

Suitably, a support is arranged on the anode and/or cathode side to support the cation selective separator.

The anode can be made of any suitable material, e.g. titanium. The anode suitably is coated with e.g. $RuO_2/TiO_2$ or Pt/Ir. Preferably the anode is a DSA™ (dimension stable anode) which may have an expanded mesh substrate.

The gas diffusion electrode may be a weeping gas diffusion electrode, a semihydrophobic gas diffusion electrode or any other gas diffusion electrodes such as those described in European patent applications No. 01850109.8, No.00850191.8, No.00850219.7 and U.S. Pat. Nos. 5,938,901 and 5,766,429. There is no particular restriction on the gas diffusion electrode. For example, a gas diffusion electrode comprising only a reaction layer and a gas diffusion layer may be used. The gas diffusion layer may be made from a mixture of carbon and a PTFE resin. The reaction layer suitably has a content of a hydrophobic material such as fluorocarbon compounds in order to retain proper water repellency and a hydrophilic property. In addition, a protective layer for more effectively preventing the gas diffusion layer from becoming hydrophilic may be formed on the surface of the gas diffusion layer.

The process of the invention can be described as being cyclic since in a first step, an electrolyte solution comprising alkali metal chloride solution is passed to an electrolytic cell wherein at least a part of the chloride is electrolysed to form inter alia hypochlorite and chlorate. The electrolysed solution is suitably withdrawn to a conventional chlorate reactor, e.g. such as described in U.S. Pat. No. 5,419,818 for further reaction to produce chlorate. The chlorate reactor may comprise several chlorate vessels. Chlorate electrolyte can then be transferred to a crystalliser, where solid alkali metal chlorate may be separated by means of crystallisation while the mother liquor containing inter alia unreacted chloride ions, hypochlorite, chlorate may be recirculated to the electrolytic cell for further electrolysis. Also an alkali metal hydroxide scrubber may be used as a chlorate reactor in which chlorate can be formed by reacting alkali metal hydroxide supplied thereto from e.g. the alkali metal hydroxide chamber and formed chlorine gas withdrawn from the anode compartment. According to one preferred embodiment, both an alkali metal hydroxide scrubber to which chlorine gas is supplied and a chlorate reactor supplied with electrolysed solution are used simultaneously in the process.

A concentrated chlorate electrolyte may contain from about 200 to about 1200 g/l, preferably from about 650 to about 1200 g/l.

The electrolyte solution introduced into the anode compartment suitably contains at least some chlorate, suitably in the range of from about 1 to about 1000, preferably from about 300 to about 650, and most preferably from about 500 to about 650 g/liter calculated as sodium chlorate. Suitably, the electrolyte solution has a concentration of chloride ions in the range from about 30 to about 300 g/l, preferably from about 50 to about 250 g/l, and most preferably from about 80 to about 200 g/l, calculated as sodium chloride.

According to another preferred embodiment, the chlorate concentration in the electrolyte solution introduced into the anode compartment is from about 1 to about 50 g/l, preferably from about 1 to about 30 g/l.

Suitably, most of the chlorine gas generated in the anode compartment is dissolved in the electrolysed solution. Dissolved chlorine spontaneously undergoes partial hydrolysis to form hypochlorous acid according to the formula:

$$Cl_2+H_2O \rightarrow HClO+HCl$$

The hypochlorous acid is dissociated in the presence of a buffer or hydroxide ions ($B^-$) to hypochlorite according to the formula $$HClO+B^- \rightarrow HB+ClO^-$$

The pH of the electrolysed solution in the anode compartment preferably is above 4 in order to stimulate the dissolution of chlorine. The electrolysed solution containing chlorine and/or hypochlorous acid can be transferred to the chlorate reactor. The pH of the electrolyte solution supplied to the anode compartment suitably ranges from about 2 to about 10, preferably from about 5.5 to about 8. The concentration of alkali metal hydroxide in the alkali metal hydroxide chamber suitably ranges from about 10 to about 500, preferably from about 10 to about 400, more preferably from about 20 to about 400, and most preferably from about 40 to about 160 g/l calculated as sodium hydroxide. The alkali metal hydroxide produced can be directly withdrawn or recirculated to the alkali metal hydroxide chamber for further electrolysis until the desired concentration has been achieved. The produced alkali metal hydroxide can be used for alkalisation of the chlorate electrolyte in the chlorate reactor and before crystallisation of chlorate. The alkali metal hydroxide can also be used for precipitating hydroxides of alkaline earth metals, iron and aluminium for purification of fresh alkali metal chloride used in the electrolyte solution. Alkali metal hydroxide can also be used for chlorine absorption from process vent from the chlorate reactor and as earlier stated, for absorption of chlorine gas withdrawn from the anode compartment for direct production of alkali metal chlorate in an alkali metal hydroxide scrubber.

According to one preferred embodiment, alkali metal chromate is added to the electrolyte solution as pH buffering and to suppress undesired reactions. Chromate may be added in an amount from about 0.01 to about 10 g/l, preferably up to about 6 g/l. According to another preferred embodiment, no chromate is added to the electrolyte solution.

The temperature in the electrolytic cell suitably ranges from about 20 to about 105° C., preferably from about 40 to about 100° C.

The chlorate is preferably produced by a continuous process, but a batchwise process can also be used. The process of the present invention may advantageously be integrated in the production of chlorine dioxide using either chlorate electrolyte or alkali metal chlorate salt as raw material.

The invention also relates to an electrolytic cell for producing alkali metal chlorate comprising a cation selective separator dividing the cell into an anode compartment in which an anode is arranged and a cathode compartment in which a gas diffusion electrode is arranged. An inlet for electrolyte solution and an outlet for electrolysed solution are provided in the anode compartment, and an inlet for introducing oxygen-containing gas is provided in the cathode compartment.

According to one preferred embodiment, the gas diffusion electrode is arranged on the separator to minimise the ohmic resistance.

According to another preferred embodiment, the gas diffusion electrode divides the cathode compartment into a gas chamber on one side of the gas diffusion electrode and an alkali metal hydroxide chamber on the other side thereof confined between the gas diffusion electrode and the cation selective separator. An inlet and an outlet for alkali metal hydroxide solution is provided in the alkali metal hydroxide chamber.

Preferably, the cation selective separator may be any of the cation selective membrane described above. Preferably, also an outlet for oxygen-containing gas is provided in the gas chamber. Preferably, a separate outlet for chlorine gas is provided in the anode compartment and/or in the chlorate reactor. Chlorine gas may also leave the anode compartment via the outlet for electrolysed solution. According to one embodiment of the invention, the anode compartment is not provided with a separate outlet for chlorine gas.

The construction of the above described embodiments of electrolytic cells preferably is so robust that the cells can withstand electrolyte flows and other physical conditions that are conventional in the art of chlorate production. Preferably, the cell is constructed to withstand a flow in the anode and/or the cathode compartment preferably of at least about 0.5 $m^3h^{-1}m^{-2}$, more preferably at least about 1 $m^3h^{-1}m^{-2}$, even more preferably at least about 3 $m^3h^{-1}m^{-2}$, and most preferably at least about 5 $m^3h^{-1}m^{-2}$. Preferably, also inlets and outlets are so designed to cope with these conditions.

The invention further concerns a plant comprising an electrolytic cell as described above in which the outlet of the anode compartment is connected to a chlorate reactor, suitably via the outlet for electrolysed solution. The chlorate reactor may in turn be connected to a crystalliser for transferring chlorate electrolyte which can be precipitated in the crystalliser and separated from the mother liquor. The chlorate reactor is suitably connected to the anode compartment such that a part of the alkali metal chlorate electrolyte can be recirculated to the anode compartment.

The plant suitably comprises storage vessels for alkali metal chloride and/or electrolyte treatment agents such as alkali metal chromate.

The reactor may also be an alkali metal hydroxide scrubber to which chlorine gas can be withdrawn from the anode compartment and reacted with alkali metal hydroxide to produce alkali metal chlorate. Suitably, an alkali metal hydroxide container is connected to the alkali metal hydroxide chamber for supply and circulation of alkali metal hydroxide. The container, suitably a tank, can be continuously fed with water and recirculated alkali metal hydroxide to adjust the concentration of the alkali metal hydroxide concentration fed to the alkali metal hydroxide chamber. The outlet of the alkali metal hydroxide chamber may be connected to several units in the chlorate plant for alkalisation, e.g. to the inlet for alkali metal hydroxide scrubber or other chlorate reactor, or to the crystalliser for transferral of alkali metal hydroxide. Preferably, both an alkali metal hydroxide scrubber and a conventional chlorate reactor receiving electrolysed solution are arranged in the plant.

The invention also relates to the use of the electrolytic cell and the plant comprising the electrolytic cell for the production of alkali metal chlorate, preferably sodium chlorate, but also e.g. potassium chlorate. The sodium chlorate may be produced as solid sodium chlorate salt or sodium chlorate electrolyte for production of chlorine dioxide, preferably by means of an on-site chlorine dioxide generator.

DESCRIPTION OF EMBODIMENTS

Figure 1:
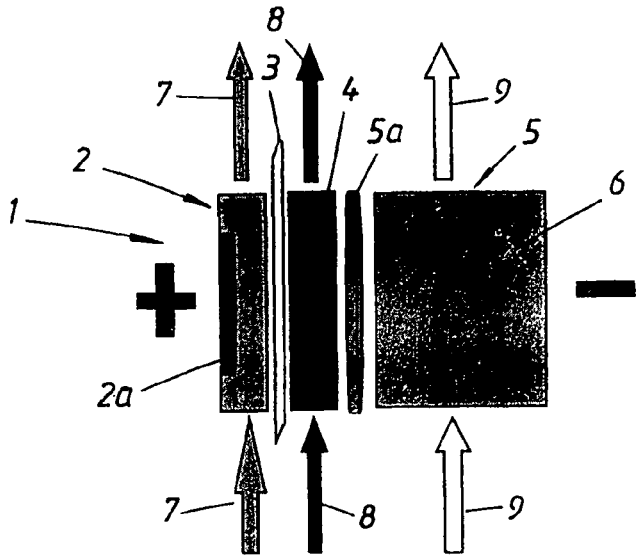
FIG. 1 schematically illustrates an electrolytic cell according to one embodiment of the invention.

FIG. 1 shows an electrolytic cell 1 for the production of sodium chlorate. The cell comprises an anode compartment 2 in which an anode 2*a* is arranged, a cation selective membrane 3, a cathode compartment 5 divided by a gas diffusion electrode 5*a* into an alkali metal hydroxide chamber 4 and a gas chamber 6. Inlets and outlets for sodium chloride and electrolyte in the anode compartment 2 are illustrated by arrows 7. A separate outlet for chlorine gas may be provided in the anode compartment (not shown). Inlets and outlets for sodium hydroxide in the alkali metal hydroxide chamber are illustrated by arrows 8. Inlets and outlets for oxygen in the gas chamber 6 are illustrated by arrows 9. A further arrangement of the electrolytic cell (not shown) comprises a two compartment cell, i.e. without a separate gas chamber, in which the gas diffusion electrode is arranged directly on the cation selective separator.

Figure 2:
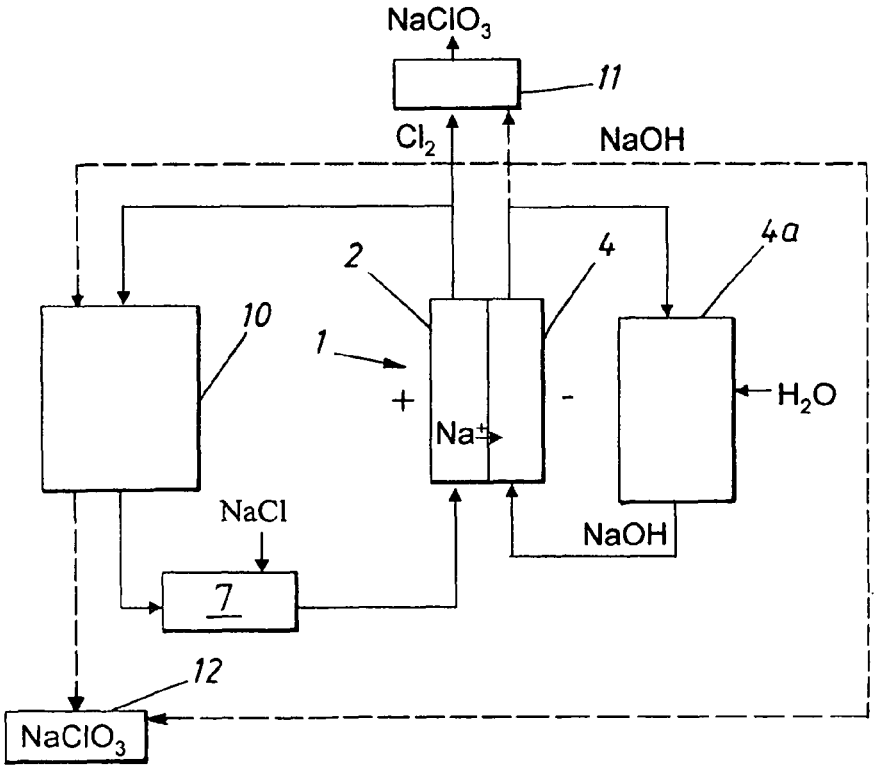
FIG. 2 schematically illustrates a plant for producing sodium chlorate according to the invention.

FIG. 2 schematically illustrates a plant for producing sodium chlorate. An electrolyte solution 7 comprising sodium chloride and chlorate electrolyte obtained from chlorate reactor 10 is introduced into the anode compartment 2 of an electrolytic cell 1. The electrolyte solution is electrolysed to form an electrolysed solution which is pumped through the anode compartment 2 to the chlorate reactor 10 where the formation of chlorate continues. The chlorate electrolyte in the chlorate reactor 10 is alkalised with alkali metal hydroxide produced in the cathode chamber 4 before it is withdrawn to the crystalliser 12, where sodium chlorate is crystallised. Chlorate electrolyte may also be withdrawn to a reaction vessel (not shown) for production of chlorine dioxide. In the anode compartment 2, some amount of chlorine gas may be produced during the electrolysis. The formed chlorine gas may be transferred to a sodium hydroxide scrubber 11 where the chlorine gas is absorbed in sodium hydroxide Which results in the formation of sodium chlorate. The sodium hydroxide scrubber may thus also work as a sodium chlorate reactor. Sodium chloride may continuously be added to the electrolyte solution 7 before introduction into the anode compartment. Water may be continuously added to a sodium hydroxide tank 4*a* to maintain an appropriate concentration of the sodium hydroxide passing through the sodium hydroxide chamber. Sodium hydroxide may be used for alkalisation also in the crystalliser 12.

EXAMPLE 1

The experiment was run as a batch process with a start volume in the reactor vessel of 2 liters. The start concentration of the electrolyte in the anode compartment was 110 g of NaCl/l, 550 g of $NaClO_3$ and 3 g $Na_2Cr_2O_7$/l. This solution was pumped through the anode compartment of an electrolytic cell at a rate of 25 l/h corresponding to an approximate linear velocity across the anode of 2 cm/s. Sodium hydroxide solution of a concentration of 50 g/l was pumped through the cathode compartment at linear velocity across the cathode of 2 cm/s. An excess of oxygen gas was fed to the gas compartment. The cell was a laboratory cell containing an anode compartment with a dimensionally stable (DSA) chlorine anode and a cathode compartment with a silver plated nickel wire gas diffusion electrode loaded with uncatalyzed carbon (5-6 $mg/cm^2$). The area of each electrode was 21.2 $cm^2$. The anode and cathode compartments were separated by a cation selective membrane, Nafion 450, and the distance between each electrode and the membrane was 8 mm.

Solid sodium chloride was added to the reactor vessel and fed to the anode compartment, at a rate of 0.71 g-$Ampere^{-1}h^{-1}$ to keep the concentration of sodium chloride constant in the reactor vessel. Water was added to the cathode compartment at a rate of 0.5 ml*$Ampere^{-1}min^{-1}$ to keep the concentration of sodium hydroxide constant. Electrolysis was conducted at a temperature of 70° C. in the electrolysis cell, a current density of 0.2-3 $kA/m^2$ and at a pH of 6.2. The current was varied between 0.5-6.3 A. The electrolysis was run for 30 h.

The current efficiency for the electrolysis was 92% calculated on the hydroxide ions produced in the cathode compartment. The current efficiency was calculated as the quotient between actual and theoretical maximum production of sodium hydroxide. The production of hydroxide ions was determined by analyzing the hydroxide ion content in the catholyte and multiplying it by the collected flow. The production of $NaClO_3$ was calculated from the total amount of $NaClO_3$ formed in the anode compartment throughout the electrolysis. The estimated current efficiency for chlorine formed was close to 100%. The current efficiency for the chlorate production was 95% calculated as the quotient between actual recovered and theoretical maximal production of sodium chlorate.

EXAMPLE 2

The experiment was run as a batch process with a start volume in the reactor vessel of 2 liters. The start concentration of the electrolyte in the anode compartment was 110 g of NaCl/l, 550 g of $NaClO_3$, and 3 g $Na_2Cr_2O_7$/l. This solution was pumped through the anode compartment of an electrolytic cell at a rate of 25 l/h corresponding to an approximate linear velocity across the anode of 2 cm/s. An excess of oxygen gas was fed to the gas compartment. The cell was a laboratory cell containing an anode compartment with a dimensionally stable (DSA) chlorine anode and a cathode compartment with a gas diffusion electrode made of silver, PTFE and carbon on a silver screen). The area of each electrode was 21.2 $cm^2$. The anode compartment and the gas diffusion electrode were separated by a cation selective membrane (Nafion 450). The distance between the anode and the membrane was 8 mm. There was no distance between the membrane and the gas diffusion electrode. Solid sodium chloride was added to the reactor vessel and fed to the anode compartment at a rate of 0.71 $g*A^{-1}h^{-1}$ to keep the concentration of the sodium chloride constant in the reactor vessel. Electrolysis was conducted at a temperature of 70° C. in the electrolysis cell, a current density of 0.2-3 $kA/m^2$ and a pH of 6.2. The current was varied between 0.5-6.3 A. The electrolysis was run for 30 h. The production of $NaClO_3$ was calculated from the total amount of $NaClO_3$ formed in the anode compartment throughout the electrolysis. The estimated current efficiency for chlorine formed was close to 100%. The current efficiency for the chlorate production was 97% calculated as the quotient between the actual recovered and the theoretical maximal production of sodium chlorate.

The invention claimed is:

1. A process for producing alkali metal chlorate in an electrolytic cell, said cell being divided by a cation selective separator into an anode compartment in which an anode is arranged and a cathode compartment in which a gas diffusion electrode is arranged, said process comprising introducing an electrolyte solution having a pH from about 5.5 to about 8 containing alkali metal chloride into the anode compartment and an oxygen-containing gas into the cathode compartment; electrolysing the electrolyte solution to produce alkali metal chlorate in an electrolysed solution in the anode compartment, electrolysing oxygen introduced into the cathode compartment resulting in the formation of alkali metal hydroxide in the cathode compartment; transferring the electrolysed solution from the anode compartment to a chlorate reactor to react the electrolysed solution further to produce a concentrated alkali metal chlorate electrolyte and where the formation of chlorate continues wherein the concentrated electrolyte contains from about 650 to about 1200 g/l of chlorate.

2. A process according to claim 1, wherein said gas diffusion electrode divides the cathode compartment into a gas chamber on one side of the gas diffusion electrode and an alkali metal hydroxide chamber on the other side thereof confined between the gas diffusion electrode and the cation selective separator, introducing an alkali metal hydroxide solution into the alkali metal hydroxide chamber and the oxygen-containing gas into the gas chamber.

3. A process according to claim 1, wherein the cation selective separator is a cation selective membrane.

4. A process as claimed in claim 1, wherein the electrolyte solution has an alkali metal chloride concentration from about 50 to about 250 g/l.

5. A process as claimed in claim 1, wherein the electrolyte solution introduced into the anode compartment has an alkali metal chlorate concentration from about 300 to about 650 g/l.

6. A process as claimed in claim 1, wherein the electrolyte solution has an alkali metal chlorate concentration from about 1 to about 50 g/l.

7. A process as claimed in claim 1, wherein the electrolyte solution has an alkali metal chromate concentration is from about 0.01 to about 10 g/l.

8. A process as claimed in claim 1, wherein the electrolyte solution contains no alkali metal chromate.

9. A process as claimed in claim 1, wherein the cathode compartment has an alkali metal hydroxide concentration from about 10 to about 400 g/l.

10. A process according to claim 9, wherein the cathode compartment has an alkali metal hydroxide concentration from about 40 to about 160 g/l.

11. A process as claimed in claim 1, wherein the cell has a temperature from about 40 to about 100° C.

12. A process as claimed in claim 1, wherein alkali metal hydroxide is transferred to the chlorate reactor.

13. A process according to claim 12, further comprising transferring a portion of the electrolyzed solution containing alkali metal hydroxide from the cathode compartment and chlorine gas formed in the anode compartment to an alkali metal hydroxide scrubber and forming additional chlorate in said scrubber.

14. A process according to claim 1, wherein said gas diffusion electrode divides the cathode compartment into a gas chamber on one side of the gas diffusion electrode and an alkali metal hydroxide chamber on the other side thereof confined between the gas diffusion electrode and the cation selective separator, introducing an alkali metal hydroxide solution into the alkali metal hydroxide chamber and the oxygen-containing gas into the gas chamber, wherein the cation selective separator is a cation selective membrane, and wherein the electrolyte solution has a pH from about 5.5 to about 8.

15. A process according to claim 1, wherein said gas diffusion electrode is arranged on the separator.

16. A process for producing alkali metal chlorate in an electrolytic cell, said cell being divided by a cation selective separator into an anode compartment in which an anode is arranged and a cathode compartment in which a gas diffusion electrode is arranged, wherein said gas diffusion electrode divides the cathode compartment into a gas chamber on one side of the gas diffusion electrode and an alkali metal hydroxide chamber on the other side thereof confined between the gas diffusion electrode and the cation selective separator, said process comprising introducing an electrolyte solution containing alkali metal chloride and alkali metal chlorate into the anode compartment, wherein said electrolyte solution has an alkali metal chloride concentration from about 50 to about 250 g/l, an alkali metal chlorate concentration from about 300 to about 650 g/l and a pH from about 5.5 to about 8, and introducing an aqueous solution consisting essentially of water and alkali metal hydroxide, having an alkali metal hydroxide concentration from about 40 to about 160 g/l, into the alkali metal hydroxide chamber and oxygen-containing gas into the gas chamber; electrolyzing the electrolyte solution to produce alkali metal chlorate in an electrolyzed solution in the anode compartment, electrolyzing oxygen introduced into the cathode compartment resulting in the formation of alkali metal hydroxide in the cathode compartment; transferring the electrolyzed solution from the anode compartment to a chlorate reactor to react the electrolyzed solution further to produce a concentrated alkali metal chlorate electrolyte and where the formation of chlorate continues wherein the concentrated electrolyte contains from about 650 to about 1200 g/l of chlorate, wherein the electrolyzing is carried out at a current density in the range of 0.2 to 3 $kA/m^2$.

17. A process according to claim 16, wherein the alkali metal chloride concentration is from about 80 to about 250 g/l.

18. A process according to claim 17, wherein the alkali metal chloride concentration is from about 110 to about 250 g/l.

19. A process according to claim 17, further comprising transferring a portion of the electrolyzed solution containing alkali metal hydroxide from the cathode compartment and chlorine gas formed in the anode compartment to an alkali metal hydroxide scrubber and forming additional chlorate in said scrubber.

* * * * *